US007338352B2

(12) United States Patent
Seong et al.

(10) Patent No.: US 7,338,352 B2
(45) Date of Patent: Mar. 4, 2008

(54) SLURRY DELIVERY SYSTEM, CHEMICAL MECHANICAL POLISHING APPARATUS AND METHOD FOR USING THE SAME

(75) Inventors: Choong-Kee Seong, Seoul (KR); Chang-Ki Hong, Seongnam-si (KR); Jae-Dong Lee, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 11/434,215

(22) Filed: May 16, 2006

(65) Prior Publication Data

US 2006/0262641 A1 Nov. 23, 2006

(30) Foreign Application Priority Data

May 18, 2005 (KR) ..... 10-2005-0041598

(51) Int. Cl.
*B24B 1/00* (2006.01)

(52) U.S. Cl. ..... 451/60; 451/446

(58) Field of Classification Search ..... 451/36, 451/41, 60, 285, 67, 446
See application file for complete search history.

(56) References Cited

U.S. PATENT DOCUMENTS 6,053,803 A * 4/2000 Pizzimenti et al. ..... 451/102
6,168,503 B1 * 1/2001 Pao et al. ..... 451/40
2002/0061722 A1 * 5/2002 Kondo et al. ..... 451/446

FOREIGN PATENT DOCUMENTS

| | | |
|---|---|---|
| JP | 2000-277468 | 10/2000 |
| KR | 1020040004794 A | 1/2004 |
| KR | 1020040040965 A | 5/2004 |

* cited by examiner

*Primary Examiner*—Jacob K. Ackun, Jr.
(74) *Attorney, Agent, or Firm*—Harness, Dickey & Pierce, P.L.C.

(57) ABSTRACT

A slurry delivery system, a chemical mechanical polishing (CMP) apparatus, and method for using the same are provided. An apparatus for supplying slurry to a polishing unit may include a first feed line through which an abrasive may be supplied at a first velocity. A velocity-changing member may be connected to the first feed line, and/or a velocity of the abrasive may be changed from the first velocity to. the second velocity different from the first velocity by the velocity-changing member. A second feed line may be connected to the velocity-changing member and/or an additive may be supplied through the second feed line. A supply line may be connected to the velocity-changing member. A slurry, which may be a mixture of the abrasive and/or the additive, may be supplied to a polishing unit through the supply line. Accordingly, the slurry may be more uniformly mixed and/or supplied to a polishing unit.

6 Claims, 4 Drawing Sheets

SLURRY DELIVERY SYSTEM, CHEMICAL MECHANICAL POLISHING APPARATUS AND METHOD FOR USING THE SAME

PRIORITY STATEMENT

This application claims benefit of Korean Patent Application No. 2005-41598, filed on May 18, 2005, in the Korean Intellectual Property Office, the contents of which are herein incorporated by reference in its entirety.

BACKGROUND OF THE INVENTION

1. Field of the Invention

Example embodiments of the present invention relate to a slurry delivery system, a chemical mechanical polishing (CMP) apparatus and method for using the same. Other example embodiments of the present invention relate to a slurry delivery system for increasing a mixing uniformity of a slurry for a polishing process, a CMP apparatus having a slurry delivery system and method for using the same.

2. Description of the Related Art

As semiconductor devices on high density wafers become highly integrated, forming a finer pattern, wiring of multilayer structures and scaling-down the width of the pattern and/or the wiring may be necessary. Thus, structures on the wafer may become more complicated and the difference in the number of steps for fabricating the structures may gradually increase. An increase in the number of steps for fabricating the structures on the wafer may cause various additional process-related failures in each unit during the manufacturing process. Various planarization processes may be introduced in the semiconductor device manufacturing process so as to reduce the difference the number of steps for fabricating the structures. Among the planarization processes, a chemical mechanical polishing (CMP) process may be used for manufacturing a semiconductor device.

In the CMP process, a top surface of the wafer may be chemically and/or mechanically planarized using a polishing mixture. It is know in the art that the polishing mixture may be a slurry, for example, a slurry including an abrasive and/or a chemical additive. A thin layer on the wafer may capable of contacting a polishing unit, and the slurry may be supplied to the polishing unit while the wafer may be rotated with respect to the polishing unit. Accordingly, the thin layer on the wafer, which may be reduced, etched and/or removed, may be planarized by a chemical reaction with the chemical additive and/or by a mechanical abrasion using the abrasive against the polishing unit.

When a thin layer to be polished includes silicon oxide ($SiO_2$), a ceria material based on cerium (Ce) (e.g., cerium oxide ($CeO_2$)) may be used as the abrasive in the slurry (hereinafter, referred to as a "ceria slurry"). The polishing rate of an oxide layer may be higher than a nitride layer in a CMP process using the ceria slurry. Planarizing an oxide layer using a nitride layer as an insulating layer, or stopper layer, by a CMP process may improve the CMP characteristics when using the ceria slurry opposed to using a slurry including silicon oxide particles as the abrasive (which is known as a silica slurry). Further, the variation in thickness of the nitride layer, which may remain on the wafer after the CMP process, may be improved when using the ceria slurry opposed to using the silica slurry.

A conventional ceria slurry may be a mixture of an abrasive including a ceria material and/or various additives. A sufficient amount of the ceria slurry may have been formed prior to a mixture of the abrasive and/or the additive.

The ceria slurry may be delivered to a polishing unit during the polishing process. Over a period of time, the ceria particles in the ceria slurry may agglomerate to a lump of ceria material in a mixture of the abrasive and/or the additive. Supplying the ceria slurry, including the lump of ceria material, to a polishing unit by a CMP process may create fine scratches on a surface of the wafer. The scratches may cause additional failures in subsequent semiconductor device manufacturing processes.

A point-of-use slurry delivery system may be used to overcome the above-mentioned problem. In the above point-of-use slurry delivery system, the abrasive and the additives may be individually delivered and/or mixed with each other just before initiation of a CMP process. Substantially no time may be allowed for the agglomeration of the ceria material, thereby reducing, or preventing, agglomeration of the ceria slurry. Point-of-use slurry delivery systems are known in the art. It is also known in the art that the abrasive and/or the additives may be delivered to a slurry nozzle through individual lines or may be mixed with each other into the slurry just before reaching the slurry nozzle, so that the slurry may be provided to a polishing unit as soon as the abrasive and the additives are mixed with each other.

However, the above point-of-use slurry delivery system, the abrasive and/or the additives may not uniformly mixed with each other in the slurry due to a shorter mixing time. When the abrasive and/or the additives are non-uniformly distributed in the slurry, a polished amount of a thin layer may vary from an each point of the wafer on which the thin layer may be formed in a CMP process. The top surface of the thin layer may not sufficiently planarized, despite the CMP process. Further, a mixing ratio of the abrasive and/or the additives in the slurry may vary as the wafers change, so the polished amount of a thin layer may also be varied for every wafer, thereby decreasing standardization of a CMP process.

SUMMARY OF THE INVENTION

Example embodiments of the present invention provide a slurry delivery system, a chemical mechanical polishing apparatus and method for using the same.

Other example embodiments of the present invention provide a slurry delivery system for mixing an abrasive and/or an additive prior to use on a polishing unit with increased mixing uniformity, a chemical mechanical polishing apparatus having a slurry delivery system and method for using the same.

According to an embodiment of the present invention, there is provided a slurry delivery system which may include a first feed line which an abrasive may be fed, or passed, through at a first velocity; a velocity-changing member connected to the first feed line; a second feed line and/or a supply line connected to the velocity-changing member. The velocity-changing member may change the first velocity of the abrasive to a second velocity different from the first velocity. An additive may be supplied through the second feed line while the first velocity of the abrasive may be changed to the second velocity by the velocity-changing member. A slurry for a polishing process, which may be a mixture of the abrasive and/or the additive, may be supplied through the supply line to a polishing unit.

According to another embodiment of the present invention, there is provided a slurry delivery system which may include a first feed line which an abrasive may be fed, or passed, through; a second feed line which an additive may be fed, or passed, through; a supply line connected to the first feed line and/or the second feed line; and/or a buffering line having a cross sectional area larger than the supply line and connected to the supply line. A mixture of the abrasive and/or the additive may be supplied to a polishing unit as the slurry; and a flow velocity of the slurry may be reduced by the buffering line. Accordingly, the abrasive and/or the additive may be substantially uniformly mixed, individually and/or in combination, in the mixture. Thus, the abrasive may be more uniformly mixed; the additive may be more uniformly mixed; and the abrasive and the additive mixture may be more uniformly mixed.

The slurry delivery system may further comprise a flow limiting member for limiting a flow of the slurry to help a mixing of the slurry. In some embodiments of the present invention, the flow limiting member may be positioned substantially on, or in, a middle portion of the buffering line substantially perpendicular to a flow direction of the slurry.

According to another embodiment of the present invention, there is provided a slurry delivery system including a first feed line which an abrasive may be fed, or passed, through; a second feed line which an additive may be fed, or passed, through; a supply line connected to the first feed line and the second feed line, and/or a first velocity-changing member having a cross sectional area smaller than a cross sectional area of the supply line and/or connected to the supply line. A mixture of the abrasive and/or the additive may be supplied to a polishing unit as the slurry; and a flow velocity of the slurry may be increased by the first velocity-changing member. Accordingly, the abrasive and the additive may be substantially uniformly mixed, individually and/or in combination, in the mixture. The slurry delivery system may further comprise a second velocity-changing member and/or a third velocity-changing member. In some embodiments of the present invention, the second velocity-changing member may be coupled, or positioned within, or on, the first feed line and/or a third velocity-changing member may be coupled, or positioned within, or on, the second feed line.

According to an embodiment of the present invention, there is provided a chemical mechanical polishing apparatus which may include a polishing unit, a slurry delivery unit and/or a rotating unit. The polishing unit may be capable of contacting a polishing surface of the wafer in a polishing process. The slurry delivery unit may be positioned substantially above the polishing unit. The slurry delivery unit may have a first feed line, a second feed line, a supply line and/or a velocity-changing member. An abrasive may be supplied through the first feed line at a first velocity. The first velocity of the abrasive may be changed to a second velocity different from the first velocity by the velocity-changing member connected to the first feed line. The second feed line may be connected to the velocity-changing member. An additive may be supplied through the second feed line while the velocity of the abrasive may be changed by the velocity-changing member. A slurry for a polishing process, which may be a mixture of the abrasive and/or the additive, may be supplied to the polishing unit through the supply line connected to the velocity-changing member. The rotating unit may bring the polishing surface of the wafer into contact with the polishing unit. The rotating unit may rotate the wafer with respect to the polishing unit.

According to the present invention, the abrasive and/or the additive in the slurry may be mixed with higher uniformity before delivering the slurry to the polishing unit. Due to the more uniform distribution of the abrasive and/or the additive in the slurry, a polished amount of a thin layer may be more uniform along the wafer. Due to a more uniform mixing ratio of the abrasive and the additives in the slurry, the polished amount of a thin layer may also be more uniform for every wafer, thereby improving a polishing uniformity of a CMP process for various wafers loaded and unloaded to or from the CMP apparatus.

According to other example embodiments of the present invention, there is provide a method for mixing a slurry. The method may include feeding an abrasive at a first velocity through a first feed line, changing the first velocity to a second velocity different from the first velocity, feeding an additive through a second feed line, and/or mixing the additive with the abrasive having the second velocity, forming the slurry from a mixture of the abrasive and/or the additive.

BRIEF DESCRIPTION OF THE DRAWINGS

Example embodiments of the present invention will become readily apparent by reference to the following detailed description when considering in conjunction with the accompanying drawings.

FIG. 1 is a structural view illustrating a slurry delivery system according to an example embodiment of the present invention;

FIG. 2 is a structural view illustrating a slurry delivery system according to an example embodiment of the present invention;

FIG. 3 is a structural view illustrating a slurry delivery system according to an example embodiment of the present invention;

FIG. 4 is a structural view illustrating a slurry delivery system according to an example embodiment of the present invention; and FIG. 5 is a structural view illustrating a chemical mechanical polishing apparatus according to an example embodiment of the present invention.

DESCRIPTION OF EXAMPLE EMBODIMENTS

Figure 1:
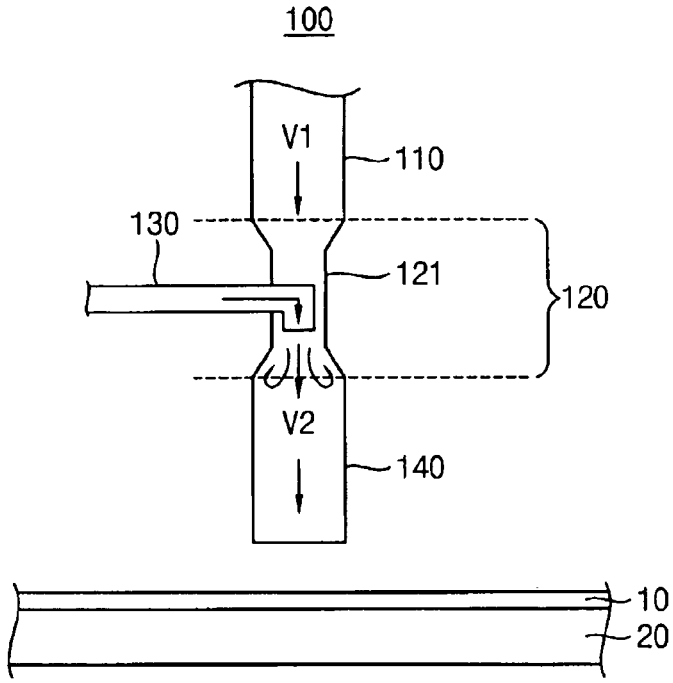
FIGS. 1-5 represent non-limiting example embodiments of the present invention as described herein.

Various example embodiments of the present invention will now be described more fully with reference to the accompanying drawings in which some example embodiments of the invention are shown. In the drawings, the thicknesses of layers and regions may be exaggerated for clarity.

Detailed illustrative embodiments of the present invention are disclosed herein. However, specific structural and functional details disclosed herein are merely representative for purposes of describing example embodiments of the present invention. This invention may, however, may be embodied in many alternate forms and should not be construed as limited to only the embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the invention to the particular forms disclosed, but on the contrary, example embodiments of the invention are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the scope of example embodiments of the present invention.

Spatially relative terms, such as "beneath", "below", "lower", "above", "upper" and the like, may be used herein for ease of description to describe one element or a feature's relationship to another element or feature as illustrated in the Figures. It will be understood that the spatially relative terms are intended to encompass different orientations of the device in use or operation in addition to the orientation depicted in the Figures. For example, if the device in the Figures is turned over, elements described as "below" or "beneath" other elements or features would then be oriented "above" the other elements or features. Thus, for example, the term "below" can encompass both an orientation which is above as well as below. The device may be otherwise oriented (rotated 90 degrees or viewed or referenced at other orientations) and the spatially relative descriptors used herein should be interpreted accordingly.

Also, the use of the words "compound," "compounds," or "compound(s)," refer to either a single compound or to a plurality of compounds. These words are used to denote one or more compounds but may also just indicate a single compound.

Example embodiments of the present invention are described herein with reference to cross-sectional illustrations that are schematic illustrations of idealized embodiments (and intermediate structures). As such, variations from the shapes of the illustrations as a result, for example, of manufacturing techniques and/or tolerances, may be expected. Thus, example embodiments of the invention should not be construed as limited to the particular shapes of regions illustrated herein but may include deviations in shapes that result, for example, from manufacturing. For example, an implanted region illustrated as a rectangle may have rounded or curved features and/or a gradient (e.g., of implant concentration) at its edges rather than an abrupt change from an implanted region to a non-implanted region. Likewise, a buried region formed by implantation may result in some implantation in the region between the buried region and the surface through which the implantation may take place. Thus, the regions illustrated in the figures are schematic in nature and their shapes do not necessarily illustrate the actual shape of a region of a device and do not limit the scope of the present invention.

It should also be noted that in some alternative implementations, the functions/acts noted may occur out of the order noted in the FIGS. For example, two FIGS. shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments of the present invention belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In order to more specifically describe example embodiments of the present invention, various aspects of the present invention will be described in detail with reference to the attached drawings. However, the present invention is not limited to the example embodiments described. In the figures, if a layer is formed on another layer or a substrate, it means that the layer is directly formed on another layer or a substrate, or that a third layer is interposed therebetween. In the following description, the same reference numerals denote the same elements.

Example embodiments of the present invention providing a slurry delivery system for more uniformly mixing an abrasive and/or an additive prior to use on a polishing unit, a chemical mechanical apparatus having the same and method for using the same will now be described more fully with reference to the accompanying drawings in which example embodiments of the present invention are shown.

FIG. 1 is a structural view illustrating a slurry delivery system 100 according to an example embodiment of the present invention.

Referring to FIG. 1, the slurry delivery system 100 may include a first feed line 110, a velocity-changing member 120, a second feed line 130 and/or a supply line 140.

An abrasive may be supplied through the first feed line 110. The abrasive may include cerium (Ce) (e.g., cerium oxide ($CeO_2$)). The abrasive may be fed, or passed, through the first feed line 110 at a first velocity ($v_1$). The abrasive may be fed, or passed, through the first feed line 110 as a laminar flow.

The velocity-changing member 120 may be coupled, or connected, to the first feed line 110. The velocity-changing member 120 may include a line-shaped member 121 having a diameter less than the first feed line 110. The velocity-changing member 120 may alter the first velocity ($v_1$) of the abrasive to a second velocity ($v_2$), wherein $v_2$ may be greater than $v_1$.

An additive may be supplied through the second feed line 130. Examples of the additive may include potassium hydroxide, sodium hydroxide, ammonium hydroxide and/or amine derivatives.

The second feed line 130 may be coupled, or connected, to the velocity-changing member 120. The second feed line 130 may extend inside the velocity-changing member 120. An end of the second feed line 130 may be directed toward a flow direction of the abrasive passing through the velocity-changing member 120. In addition, the additive may be fed, or passed, through the second feed line 130 as a laminar flow. The additive may be fed, or passed, through into the velocity-changing member 120 changing the abrasive velocity to $v_2$. The additive and/or the abrasive may be simultaneously fed, or passed, through the velocity-changing member 120.

While example embodiments of the present embodiment illustrate that the second feed line 130 may extend inside the velocity-changing member 120, the second feed line 130 may also be coupled, or connected, to the velocity-changing member 120 without extending inside the velocity-changing member 120. Alternative configurations are to be appreciated by one of ordinary skill in the art.

According to other example embodiments, the supply line 140 may be coupled, or connected, to the velocity-changing member 120. The abrasive may have the second velocity ($v_2$) and may be mixed with the additive in the velocity-changing member 120 to form a mixture of the abrasive and the additive. The mixture may move from the velocity-changing member 120 into the supply line 140. Although the abrasive and/or the additive may pass through the first and/or second feed lines as a laminar flow, the mixture may move into the supply line 140 as a turbulent flow due to the velocity-changing member 120 and/or the line-shaped member 121. Accordingly, the abrasive and/or the additive may be more uniformly mixed, individually and/or in combination, in the supply line 140 because the mixture may pass through the supply line 140 as a turbulent flow. A more uniform mixture slurry of the abrasive and/or the additive may be increased for use in a polishing process.

In example embodiments of the present invention, cerium oxide may be used as the abrasive for the slurry. The cerium oxide slurry may be referred to as a ceria slurry. The agglomeration of the abrasive and/or the additive may be reduced, or retarded, due to the turbulent flow of the slurry in the supply line 140. Accordingly, due to velocity-changing member 120, mixture uniformity of the ceria slurry may be increased.

The mixture in the supply line 140 may be supplied to a polishing unit 10 and may be used as slurry when polishing a wafer. For example, the polishing unit 10 may be coupled to a rotating platen 20.

Although example embodiments of the present invention disclose that the abrasive may be supplied through the first feed line 110 and the additive may be supplied through the second feed line 130, the abrasive and/or the additive may also be fed, or passed, through the first feed line 110 and/or second feed line 130. Such alternative configurations are to be appreciated by one of ordinary skill in the art.

Accordingly, mixture uniformity of the slurry, including the ceria slurry, may be improved, thereby increasing polishing uniformity along a wafer and/or for every wafer loaded into a polishing apparatus.

Figure 2:
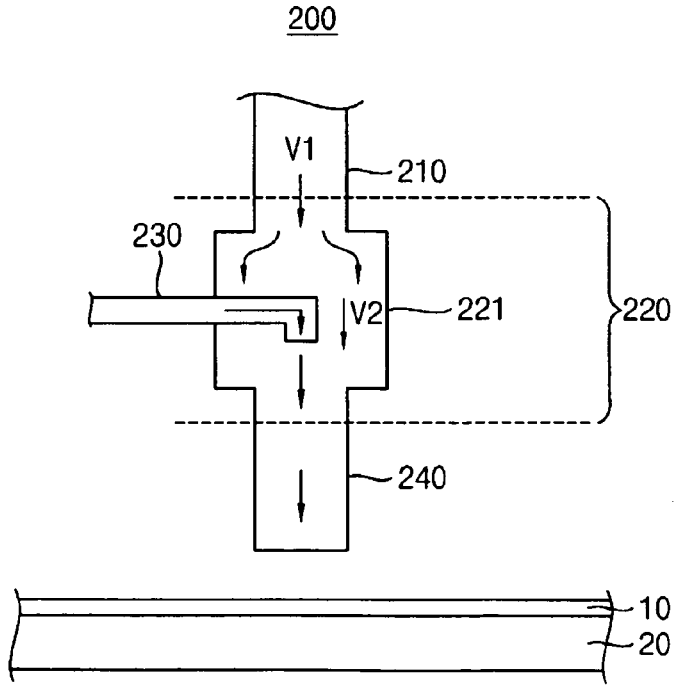

FIG. 2 is a structural view illustrating a slurry delivery system according to an example embodiment of the present invention.

Referring to FIG. 2, the slurry delivery system 200 may include a first feed line 210, a velocity-changing member 220, a second feed line 230 and/or a supply line 240.

An abrasive may be fed, or passed, through the first feed line 210. The abrasive may include cerium (Ce) (e.g., cerium oxide ($CeO_2$)). The abrasive may be fed, or passed, through the first feed line 210 at a first velocity ($v_1$) as a laminar flow.

The velocity-changing member 220 may be coupled, or connected, to the first feed line 210. The velocity-changing member 220 may include a line-shaped member 221 having a diameter, or cross sectional area, greater than the first feed line 210. The velocity-changing member 220 may alter the first velocity of the abrasive ($v_1$) to a second velocity ($v_2$) less than $v_1$. The velocity-changing member 220 may be a buffering line.

An additive may be fed, or passed, through the second feed line 230. Examples of the additive may include potassium hydroxide, sodium hydroxide, ammonium hydroxide and/or amine derivatives.

The second feed line 230 may be coupled, or connected, to the velocity-changing member 220. The second feed line 230 may extend inside the velocity-changing member 220. An end of the second feed line 230 may be directed toward a flow direction of the abrasive passing through the velocity-changing member 220. In addition, the additive may also be fed, or passed, through the second feed line 230 as a laminar flow. The additive may be supplied to the velocity-changing member 220 while the abrasive velocity may change to the second velocity. The additive and/or the abrasive may be simultaneously fed, or passed, through the velocity-changing member 220.

While example embodiments of the present embodiment disclose that the second feed line 230 may extend inside the velocity-changing member 220, the second feed line 130 may also be coupled, or connected, to the velocity-changing member 220 without extending to the inside of the velocity-changing member 220. Such alternatives are to be appreciated by one of ordinary skill in the art.

The supply line 240 may be coupled, or connected, to the velocity-changing member 220. The abrasive, which may have the second velocity ($v_2$), may be mixed with the additive in the velocity-changing member 220 to form a mixture of the abrasive and the additive. The mixture may move from the velocity-changing member 220 to the supply line 240. Although the abrasive and/or the additive may be fed, or passed, through the first and/or second feed lines as a laminar flow, the mixture may move to the supply line 240 as a turbulent flow due to the velocity-changing member 220 and/or the line-shaped member 221. Accordingly, the abrasive and/or the additive may be more uniformly mixed, individually and/or in combination, in the supply line 240 because the mixture may be supplied, or passed, through the supply line 240 as a turbulent flow. Therefore, a slurry mixture of the abrasive and/or the additive with increased mixing uniformity may be increased for use in a polishing process.

According to example embodiments of the present invention, cerium oxide may be used as the abrasive for the slurry. The cerium oxide slurry may be referred to as a ceria slurry. The agglomeration of the abrasive and/or the additive may be reduced, or retarded, due to the turbulent flow of the slurry in the supply line 240. Accordingly, the mixture uniformity of the ceria slurry may increase due to the velocity-changing member 220.

The mixture in the supply line 240 may be supplied, or passed, to a polishing unit 10 and/or may be used as slurry when polishing a wafer. For example, the polishing unit 10 may be coupled to a rotating platen 20.

Although example embodiments of the present invention disclose that the abrasive may be supplied through the first feed line 210 and the additive may be supplied through the second feed line 230, the abrasive and/or the additive may also be supplied, or passed, through the first feed line 210 and/or the second feed line 230. Such alternative configurations are to be appreciated by one of ordinary skill in the art.

Mixture uniformity of the slurry, including the ceria slurry, may be increased, thereby increasing polishing uniformity along a wafer and/or for every wafer loaded to a polishing apparatus.

Figure 3:
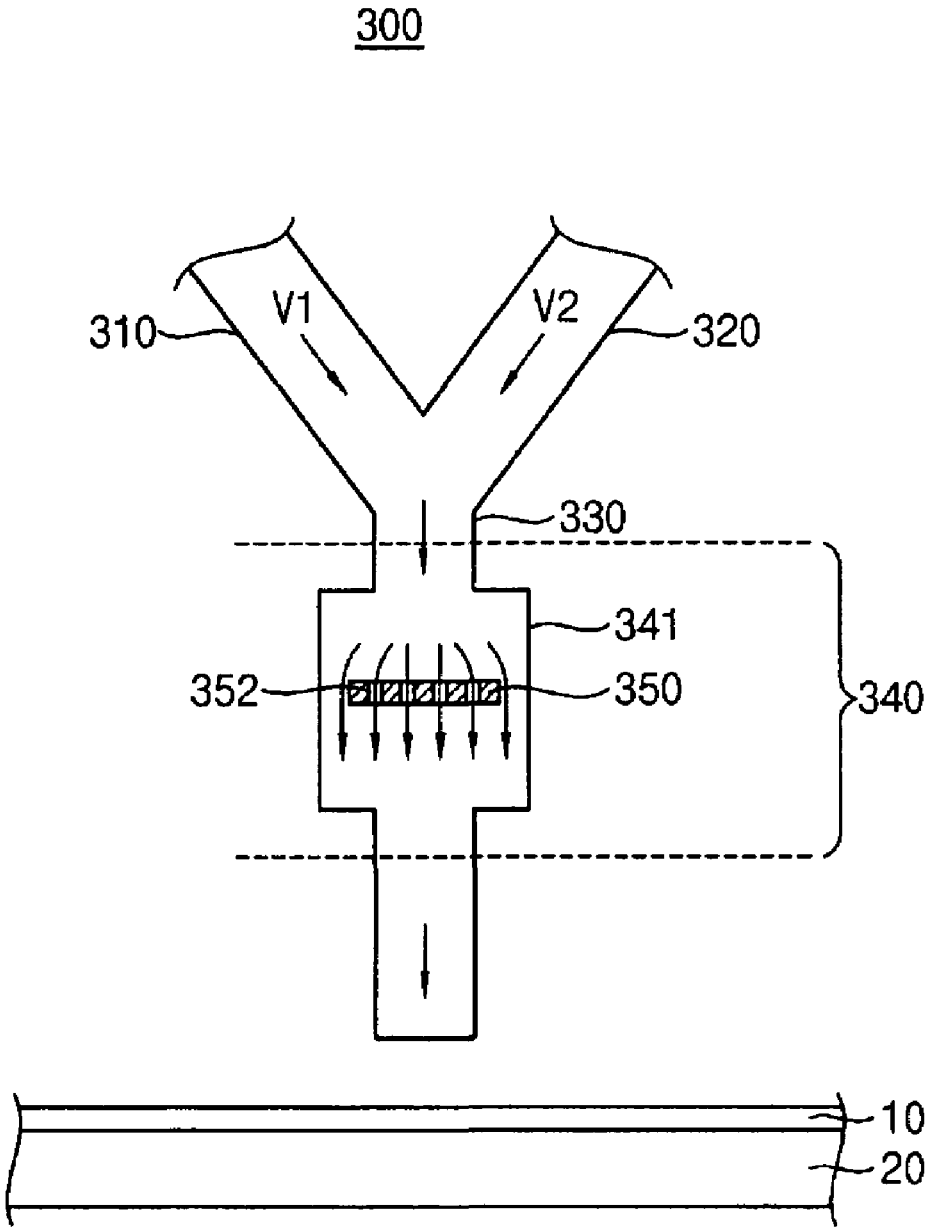

FIG. 3 is a structural view illustrating a slurry delivery system according to an example embodiment of the present invention.

Referring to FIG. 3, the slurry delivery system 300 may include a first feed line 310, a second feed line 320, a supply line 330, a velocity-changing member 340 and/or a limiting member 350.

An abrasive may be fed, or passed, through the first feed line 310. The abrasive may include cerium (Ce) (e.g., cerium oxide ($CeO_2$)). The abrasive may be fed, or passed, through the first feed line 310 at a first velocity ($v_1$). The abrasive may be fed, or passed, through the first feed line 310 as a laminar flow.

An additive may be fed, or passed, through the second feed line 320. Examples of the additive may include potassium hydroxide, sodium hydroxide, ammonium hydroxide and/or amine derivatives. The additive may be supplied at a second velocity ($v_2$) through the second feed line 320. The additive may be fed, or passed, through the second feed line 320 as a laminar flow.

The above-mentioned first velocity ($v_1$) of the abrasive may be the same as, or different from, the second velocity ($v_2$).

The supply line 330 may be coupled, or connected, to the first feed line 310 and/or the second feed line 320. The abrasive, which may be fed, or passed, through the first feed line 310, and/or the additive, which may be fed, or passed, through the second feed line 320, may be mixed in the supply line 330. The mixture in the supply line 330 may be supplied, or passed, to a polishing unit 10. The mixture in the supply line 330 may be used as a slurry when polishing a wafer. For example, the polishing unit 10 may be coupled to a rotating platen 20.

The velocity-changing member 340 may be coupled, or connected, to the supply line 330. The velocity-changing member 340 may include a line-shaped member 341 having a diameter larger than the supply line 330. A flow velocity of the mixture in the supply line 330 may be reduced by the velocity-changing member 340. The velocity-changing member 340 may be a buffering line. Although the mixture may be fed, or passed, through the supply line 330 (before moving to the velocity-changing member 340) as a laminar flow, the mixture may move through the supply line 330 (after moving through the velocity-changing member 340) as a turbulent flow due to the velocity-changing member 340 and/or the line-shaped member 341. The abrasive and/or the additive may be more uniformly mixed, individually and/or in combination, in the mixture. Therefore, the mixing uniformity of a mixture including the abrasive and/or the additive may increased. The mixture may be more uniformly mixed by the velocity-changing member 340 prior to passing through the flow limiting member 350.

The flow limiting member 350 may have a thin disk shape. The flow limiting member 350 may be positioned on a middle portion of the velocity-changing member 340 approximately perpendicularly to a flow direction of the mixture. The flow limiting member 350 may have a plurality of holes 352. The holes 352 may be at substantially regular intervals on the flow limiting member 350.

The flow limiting member 350 may limit the flow of the mixture. The mixture may flow along a side of the flow limiting member 350 and/or through the holes 352. Therefore, the mixture may be more uniformly mixed a second time by the flow limiting member 350. A slurry mixture of the abrasive and/or the additive with increased mixing uniformity may be used in a polishing process.

The mixture in the supply line 330 may be supplied to a polishing unit 10 and/or may be used as slurry when polishing a wafer.

According to example embodiments of the present invention, cerium oxide may be used as the abrasive for the slurry. The cerium oxide slurry may be referred to as ceria slurry. The agglomeration of the abrasive and/or the additive may be reduced, or retarded, due to a turbulent flow of the slurry in the velocity-changing member 340. The mixture uniformity of the ceria slurry may be increased due to the velocity-changing member.

According to other example embodiments, alternative configurations are to be appreciated. For example, a slurry delivery system may be configured similar to the slurry delivery system 200 and may include a flow limiting member similar flow limiting member 350.

Accordingly, the mixture uniformity of the slurry, including the ceria slurry, may increase, thereby increasing polishing uniformity along a wafer and/or for every wafer loaded into a polishing apparatus.

Figure 4:
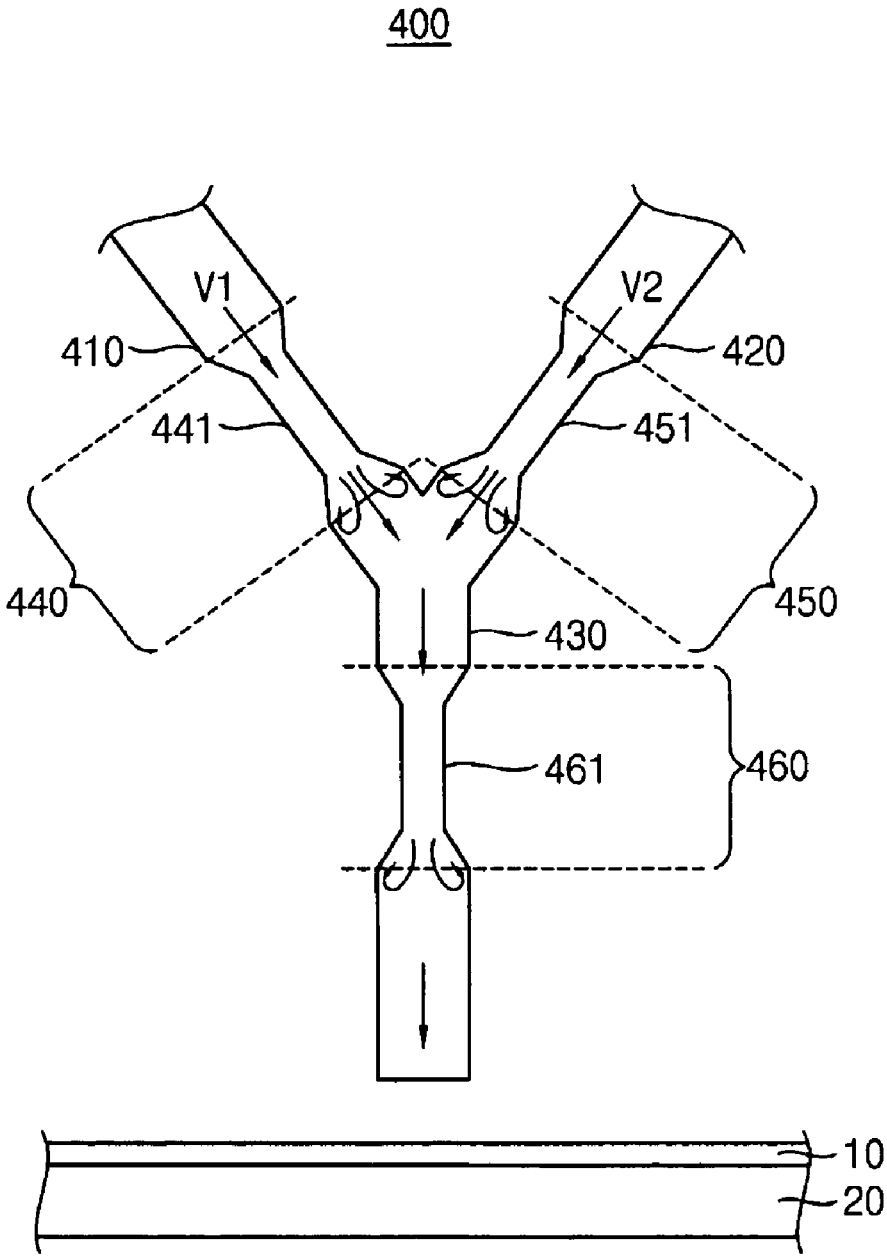

FIG. 4 is a structural view illustrating a slurry delivery system according to an example embodiment of the present invention.

Referring to FIG. 4, the slurry delivery system 400 may include a first feed line 410, a second feed line 420, a supply line 430, a first initial velocity-changing member 440, a second initial velocity-changing member 450 and/or a velocity-changing member 460.

An abrasive may be fed, or passed, through the first feed line 410. The abrasive may include cerium (Ce) (e.g., cerium oxide ($CeO_2$)). The abrasive may be fed, or passed, through the first feed line 410 at a first velocity ($v_1$). The abrasive may be fed, or passed, through the first feed line 410 as a laminar flow.

An additive may be fed, or passed, through the second feed line 420. Examples of the additive may include potassium hydroxide, sodium hydroxide, ammonium hydroxide and/or amine derivatives. The additive may be supplied, or passed, through the second feed line 420 as a laminar flow at a second velocity ($v_2$).

The first velocity ($v_1$) of the abrasive may be the same as, or different from, the second velocity ($v_2$).

The supply line 430 may be coupled, or connected, to the first feed line 410 and/or the second feed line 420. The abrasive, which may be fed, or passed, through the first feed line 410, and/or the additive, which may be fed, or passed, through the second feed line 420, may be mixed with each other in the supply line 430. The mixture in the supply line 430 may be supplied, or passed, to a polishing unit 10 and/or may be used as slurry when polishing a wafer. For example, the polishing unit 10 may be coupled to a rotating platen 20.

The first initial velocity-changing member 440 may be coupled, or connected, to a central portion of the first feed line 410. The first initial velocity-changing member 440 may include a first initial line-shaped member 441 having a diameter less than the first feed line 410. Therefore, a flow velocity of the abrasive in the first feed line 410 may be increased due to the first initial velocity-changing member 440 and/or the first initial line-shaped member 441. Although the abrasive may be fed, passed, through the first feed line 410 (before moving through the first initial velocity-changing member 440) as a laminar flow, the abrasive may move into the first feed line 410 (after moving through the first initial velocity-changing member 440) as a turbulent flow due to the first initial velocity-changing member 440 and/or the first initial line-shaped member 441.

The second initial velocity-changing member 450 may be coupled, or connected, to the second feed line 420. The second initial velocity-changing member 450 may include a second initial line-shaped member 451 having a diameter smaller than the second feed line 420. Therefore, a flow velocity of the additive in the second feed line 420 may be increased by the second initial velocity-changing member 450. Although the additive may be fed, or passed, through the second feed line 420 (before moving through the second initial velocity-changing member 450) as a laminar flow, the additive may move in the second feed line 420 (after moving through the second initial velocity-changing member 450) as a turbulent flow due to the second initial velocity-changing member 450 and/or the second initial line-shaped member 451.

The abrasive and/or the additive may be more uniformly mixed, individually and/or in combination, in the supply line 430 as a turbulent flow. The more uniform mixture in the supply line 430 may be used as slurry for polishing a wafer.

The first velocity-changing member 460 may be coupled, or connected, to a central portion of the supply line 430. The first velocity-changing member 460 may include a line-shaped member 461 having a diameter less than the supply line 430. Therefore, a flow velocity of the mixture in the supply line 430 may be increased by the first velocity-changing member 460. Although the mixture may be fed, or passed, through the supply line 430 (before moving through the first velocity-changing member 460) as a laminar flow, the mixture may move in the supply line 430 (after moving through the first velocity-changing member 460) as a turbulent flow due to the first velocity-changing member 460 and/or the line-shaped member 461. A mixture uniformity of the abrasive and/or the additive mixture, which may be used as a slurry for a polishing process, may increase.

According to example embodiments of the present invention, cerium oxide may be used as the abrasive for the slurry. Cerium oxide slurry has been referred to as ceria slurry. The agglomeration of the abrasive and/or the additive may be reduced, or retarded, due to the turbulent flow of the slurry in the supply line 430. Accordingly, the mixture uniformity of the ceria slurry may increase due to the velocity-changing members.

The mixture in the supply line 430 may be supplied, or passed, to a polishing unit 10 and/or may be used as slurry when polishing a wafer. For example, the polishing unit 10 may be coupled to a rotating platen 20.

Accordingly, mixture uniformity of the slurry, including the ceria slurry, may increase, thereby increasing polishing uniformity along a wafer and/or for every wafer loaded into a polishing apparatus.

According to other example embodiments, alternative configurations are to be appreciated. For example, a slurry delivery system may be configured similar to the slurry delivery system 300 and may include a velocity-changing member, similar to velocity changing member 340, coupled within the feed lines 310 and 320.

According to yet other example embodiments, a slurry delivery system may include a combination of velocity-changing members configured to increase and/or decrease the velocity of the abrasive and/or additive. For example, the flow velocity of the abrasive may be increased, while the flow velocity of the additive may be decreased, or vice versa. In other example embodiments, the flow velocity of the abrasive and the flow velocity of the additive may be increased, however the flow velocity of the slurry including a mixture of the additive and abrasive may be decreased.

According to other example embodiments, the feed and supply lines may have more than one velocity-changing member to increase mixture uniformity. For example, the feed lines may have two velocity-changing members configured to increase the flow velocity of the additive and/or the abrasive. In other example embodiments, the feed lines may have one velocity-changing member configured to increase the flow velocity and another velocity-changing member configured to decrease the flow velocity.

Figure 5:
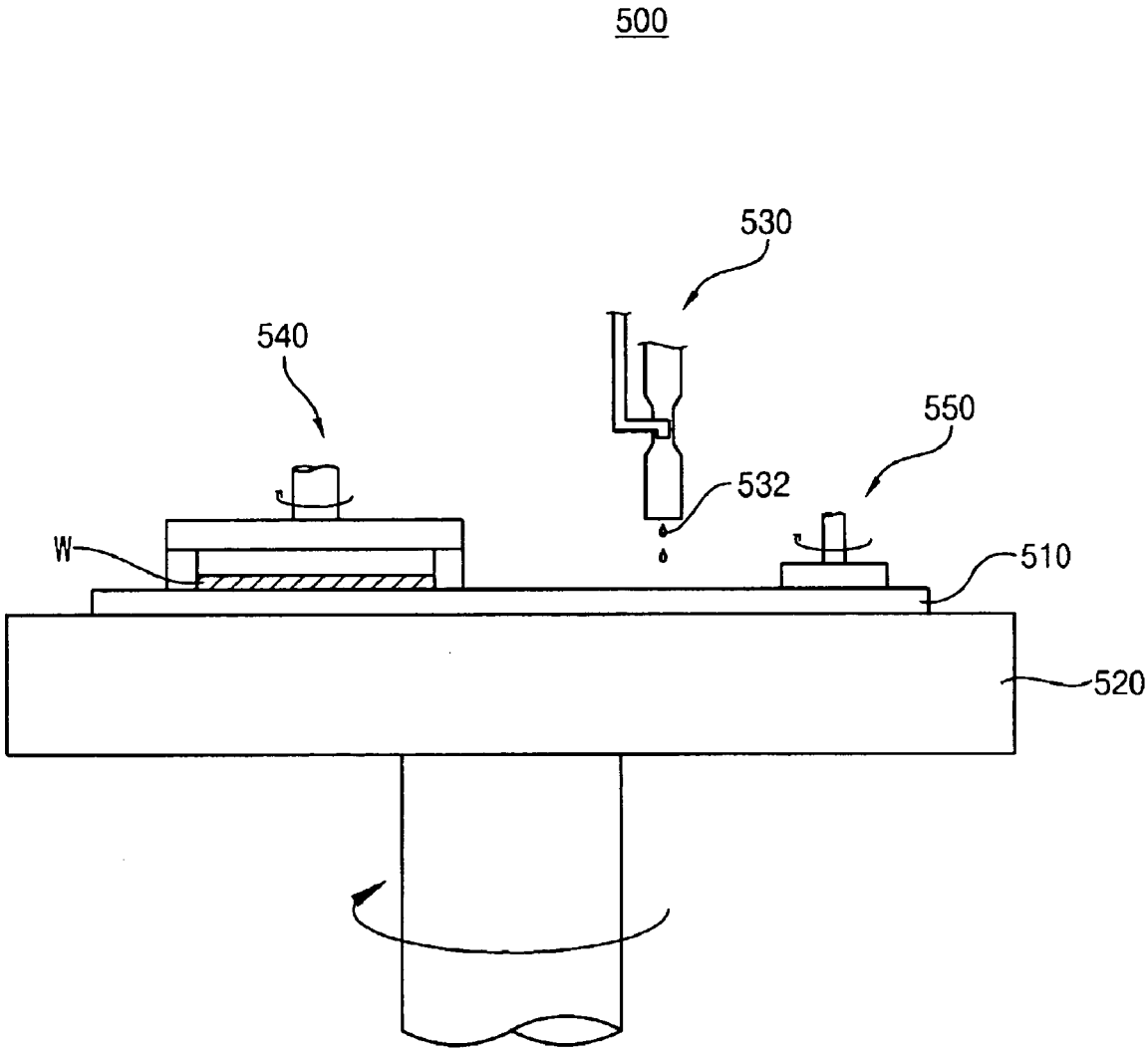

FIG. 5 is a structural view illustrating a chemical mechanical polishing apparatus according to an example embodiment of the present invention. The chemical mechanical polishing apparatus may include a slurry delivery unit. The slurry delivery unit may be the same, or similar, to slurry delivery systems 100, 200, 300 and/or 400, so any further detailed description of the slurry delivering unit will be omitted hereinafter.

Referring to FIG. 5, the chemical mechanical polishing (CMP) apparatus 500 may include a polishing unit 510, a platen 520, a slurry delivery unit 530, a rotating unit 540 and/or a unit conditioner 550.

The polishing unit 510 may contact and/or polish an object deposited, or formed, on a polishing surface of a wafer, W. The object may be polished, or etched (partially or entirely), the wafer by a CMP process using a slurry. The slurry may flow onto the polishing unit 510. In example embodiments of the present embodiment, the polishing unit 510 may include a polishing pad, which may include rigid polyurethane foam and/or non-woven polyester felt. The felt may be impregnated into and/or coated onto the rigid polyurethane foam. In other example embodiments of the present embodiment, in order for the slurry to be more uniformly supplied onto a surface of the polishing unit 510, a plurality of grooves may be formed on a top surface of the polishing unit 510 as a group of concentric circles. In yet other example embodiments, the slurry may be more uniformly supplied to the whole, or entire, surface of the polishing unit 510 by forming a plurality of grooves on a top surface of the polishing unit 510 as a group of concentric circles.

The polishing unit 510 may be attached to a top surface of the platen 520. The platen 520 may be rotated with respect to the wafer W, thereby increasing the polishing efficiency of the CMP apparatus.

The slurry delivery unit 530 may be disposed near the polishing unit 510. The system delivery unit 530 may deliver slurry 532 for polishing the object on the wafer W to the polishing unit 510. Mixture uniformity of the slurry may increase and/or the slurry may be more uniformly distributed on a surface of the wafer W by the slurry delivery unit 530. The slurry 532 may chemically react with the object on the polishing surface of the wafer W and/or may mechanically polish the object in accordance with the rotation of the platen 520.

The slurry delivery unit 530 in the CMP apparatus 500 may include elements substantially identical to the slurry delivery system described with reference to FIG. 1, so any further descriptions of the slurry delivery unit 530 are omitted hereafter. The slurry delivery systems described with reference to FIG. 2, 3 or 4, respectively, may also be used as the slurry delivery unit 530 of the CMP apparatus 500. Alternative configurations are to be appreciated by one of the ordinary skill in the art.

The wafer W, which may include the object to be polished, may be secured to the rotating unit 540 and/or may rotate with respect to the polishing unit 510. According to example embodiments of the present invention, the rotating unit 540 may include a polishing head positioned near the polishing unit 510.

The wafer W may be secured to the polishing head 540, such that the polishing surface of the wafer W substantially faces the polishing unit 510. The polishing head 540 may move substantially perpendicularly to the polishing surface of the wafer W to bring the object on the polishing surface of the wafer W in contact with the polishing unit 510 upon initiation of a CMP process. In other example embodiments of the present invention, a rear side of the wafer W, which may be opposite to the polishing surface of the wafer W, may be secured to the polishing head 540 by a vacuum absorber, and/or the polishing head 540 may move substantially perpendicularly with respect a surface of the polishing unit 510. When the object on the polishing surface of the wafer W contacts the polishing unit 510, the polishing head 540 may rotate on its own axis. Accordingly, the object on the wafer W may be more uniformly polished, or etched, due to the relative rotation of the polishing head 540 with respect to the polishing unit 510.

The unit conditioner 550 may remove byproducts of the polishing process from the polishing unit 510 and/or may maintain, or stabilize, various polishing conditions, thereby increasing polishing efficiency and/or polishing uniformity of the CMP apparatus 500. In the other example embodiments, the unit conditioner 550 may be positioned substantially above the polishing unit 510 and/or may move substantially perpendicular to a surface of the polishing unit 510 by a pneumatic cylinder (not shown). For example, the unit conditioner 550 may include a cylindrical body connected to and/or driven by the pneumatic cylinder and/or a diamond disk positioned along a peripheral portion of the cylindrical body. The diamond disk on the peripheral portion of the cylindrical body may contact a top surface of the polishing unit 510 in a CMP process, thereby reducing, or removing, the byproducts of the polishing process from the polishing unit 510.

According to the CMP apparatus provided by example embodiments of the present invention, the slurry delivery unit 530 may deliver a slurry of higher mixture uniformity to the polishing unit 510, thereby increasing polishing uniformity of a wafer and/or for every wafer loaded into a polishing apparatus. The degree of polishing uniformity at each point along the wafer and/or for every loaded wafer is increased by the CMP apparatus including the slurry delivery unit 530.

Polishing Uniformity Test Results

TABLE 1

| | Average Polishing Rate (Å/min) | Variation of the Polishing Rate (%) |
|---|---|---|
| Specimen No. 1 | 3313 | 1.54 |
| Specimen No. 2 | 3748 | 2.62 |

Verifying the increase in the polishing uniformity according to example embodiments of the present invention, first and second specimens were prepared and polished in respective CMP apparatuses. The first specimen was polished in a first CMP apparatus and the second specimen was polished in a second CMP apparatus. In the first CMP apparatus, the slurry was delivered to a polishing unit by a slurry delivery unit substantially the same as the slurry delivery system 400, except the first and second velocity-changing members 440 and 450 were detached and the third velocity-changing member 460 was installed. In contrast, in the second CMP apparatus, the slurry was delivered to a polishing unit by a slurry delivery unit that was substantially the same as the slurry delivery system 400, except all of the first, second and third velocity-changing members 440, 450 and 460 were detached. The results of the polishing uniformity test are shown in Table 1.

Table 1 shows that an average polishing rate of the first specimen is about 3313 Å/min and an average polishing rate of the second specimen is about 3748 Å/min. The average polishing rate of the first specimen may less than the second specimen.

Table 1 also shows that, variation of the polishing rate of the first specimen is about 1.54% and variation of the polishing rate of the second specimen is about 2.62%. The variation of the polishing rate of the first specimen is about 60% of the second specimen. The polishing rate variation in a CMP apparatus including the velocity-changing member is about 60% less than a CMP apparatus in which the velocity-changing member is not installed. The results on the variation of the polishing rate may indicate that one or more velocity-changing members may increase the polishing uniformity.

According to the example embodiments of the present invention, the slurry delivery unit may deliver a higher uniformity mixture of an abrasive and/or an additive to the polishing unit as slurry using a velocity-changing member and/or a buffer line, thereby increasing a polishing uniformity along a wafer. Further, an average polishing rate on a wafer may be more uniform irrespective of the wafer loaded into the polishing apparatus, thereby improving polishing reliability for every wafer loaded.

Although the example embodiments of the present invention have been described, it is understood that the present invention should not be limited to these exemplary embodiments but various changes and modifications can be made by one skilled in the art within the spirit and scope of the present invention as hereinafter claimed.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A chemical mechanical polishing apparatus comprising:

a polishing unit capable of contacting a polishing surface of a wafer;

a slurry delivery unit capable of delivering a slurry to the polishing unit, the slurry delivery unit having a first feed line to feed an abrasive at a first velocity $v_1$, a velocity-changing member connected to the first feed line, the velocity-changing member changing the first velocity $v_1$ of the abrasive to a second velocity $v_2$ different from the first velocity $v_1$, a second feed line, connected to the velocity-changing member, to pass an additive through, and a supply line connected to the velocity-changing member to supply the slurry, which is a mixture of the abrasive and the additive, to the polishing unit; and a rotating unit capable of bringing a polishing surface of the wafer into contact with the polishing unit and rotating the wafer against the polishing unit.

2. The apparatus of claim 1, wherein the velocity-changing member has a cross sectional area equivalent to or smaller than a cross sectional area of the first feed line, satisfying the expression $v_2 \geqq v_1$.

3. The apparatus of claim 2, wherein the velocity-changing member includes a line-shaped member having a cross sectional area equivalent to or smaller than a cross sectional area of the first feed line, satisfying the expression $v_2 \geqq v_1$.

4. The apparatus of claim 1, wherein the velocity-changing member has a cross sectional area equivalent to or larger than a cross sectional area of the first feed line, satisfying the expression $v_2 \geqq v_1$.

5. The apparatus of claim 4, wherein the velocity-changing member includes a line-shaped member having a cross sectional area equivalent to or larger than a cross sectional area of the first feed line, satisfying the expression $v_2 \geqq v_1$.

6. The apparatus of claim 1, wherein the second feed line extends inside the velocity-changing member.

* * * * *